US006575671B1

(12) United States Patent
North et al.

(10) Patent No.: US 6,575,671 B1
(45) Date of Patent: Jun. 10, 2003

(54) CHROMIUM-CONTAINING CEMENTED TUNGSTEN CARBIDE BODY

(75) Inventors: Bernard North, Greensburg, PA (US); Prem C. Jindal, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/637,280

(22) Filed: Aug. 11, 2000

(51) Int. Cl.[7] ..... B23B 27/14

(52) U.S. Cl. ..... 407/119; 407/118; 428/323; 51/295

(58) Field of Search ..... 407/118, 119; 51/295, 307; 408/144, 145; 428/210, 212, 216, 323, 552

(56) References Cited

U.S. PATENT DOCUMENTS

| | | | | | |
|---|---|---|---|---|---|
| 3,785,801 | A | | 1/1974 | Benjamin | 75/0.5 BC |
| 4,168,957 | A | | 9/1979 | Lee et al. | 51/309 |
| 4,277,283 | A | | 7/1981 | Tobioka et al. | 75/238 |
| 4,587,174 | A | * | 5/1986 | Yoshimura et al. | 428/552 |
| 4,610,931 | A | | 9/1986 | Nemeth et al. | 428/547 |
| 4,828,612 | A | | 5/1989 | Yohe | 75/238 |
| 4,830,930 | A | | 5/1989 | Taniguchi et al. | 428/547 |
| 4,913,877 | A | | 4/1990 | Yohe | 419/13 |
| 5,162,147 | A | * | 11/1992 | Ruppi | 428/216 |
| 5,181,953 | A | | 1/1993 | Nakano et al. | 75/237 |
| RE34,180 | E | | 2/1993 | Nemeth et al. | 428/547 |
| 5,188,489 | A | | 2/1993 | Santhanam et al. | 407/119 |
| 5,232,318 | A | | 8/1993 | Santhanam et al. | 407/119 |
| 5,283,030 | A | | 2/1994 | Nakano et al. | 419/53 |
| 5,288,676 | A | | 2/1994 | Shimada et al. | 501/93 |
| 5,305,840 | A | | 4/1994 | Liang et al. | 175/426 |
| 5,310,605 | A | | 5/1994 | Baldoni, II et al. | 428/569 |
| 5,325,747 | A | | 7/1994 | Santhanam et al. | 82/1.11 |
| 5,364,209 | A | | 11/1994 | Santhanam et al. | 407/119 |
| 5,484,468 | A | | 1/1996 | Ostlund et al. | 75/236 |
| 5,597,272 | A | * | 1/1997 | Moriguchi et al. | 407/119 |
| 5,619,000 | A | | 4/1997 | Ederyd et al. | 75/240 |
| 5,665,431 | A | | 9/1997 | Narasimhan | 427/255 |

(List continued on next page.)

FOREIGN PATENT DOCUMENTS

| | | | |
|---|---|---|---|
| DE | 4000223 | | 7/1993 |
| EP | 0685572 | | 12/1995 |
| EP | 0792390 | | 9/1997 |
| EP | 1038989 | | 9/2000 |
| JP | 5487719 | | 12/1979 |
| JP | 55-120936 | * | 9/1980 |
| JP | 55120936 | | 9/1980 |
| JP | 6330220 | | 11/1994 |
| JP | 09207008 | | 12/1997 |
| JP | 11197936 | | 1/1998 |
| JP | 11300516 | | 4/1998 |
| JP | 10219384 | | 8/1998 |
| JP | 1121651 | | 1/1999 |
| JP | 1161317 | | 3/1999 |
| JP | 11221708 | | 8/1999 |

OTHER PUBLICATIONS

US 5,143,488, 9/1992, Santhanam et al. (withdrawn)
Notification of Transmittal of the International Preliminary Examination Report mailed Sep. 16, 2002 in PCT/US01/21166.
International Preliminary Examination Report mailed Sep. 16, 2002 in PCT/US01/21166.
Written Opinion mailed Aug. 8, 2002 in PCT/US01/21170.
International Search Report PCT Patent Application US 01/21156 (mailed Dec. 3, 2002).
PCT International Application No. PCT/US01/21170—International Search Report of Apr. 5, 2002.

(List continued on next page.)

*Primary Examiner*—Henry W. H. Tsai
(74) *Attorney, Agent, or Firm*—John J. Prizzi

(57) ABSTRACT

A chromium-containing coated cemented tungsten carbide cutting insert that has a substrate and a coating. The substrate comprises between about 10.4 and about 12.7 weight percent cobalt, between about 0.2 and about 1.2 weight percent chromium.

41 Claims, 2 Drawing Sheets

U.S. PATENT DOCUMENTS

| | | | | | |
|---|---|---|---|---|---|
| 5,694,639 | A | | 12/1997 | Oskarsson et al. | 419/16 |
| 5,700,551 | A | * | 12/1997 | Kukino et al. | 428/212 |
| 5,722,803 | A | * | 3/1998 | Battaglia et al. | 407/119 |
| 5,729,823 | A | | 3/1998 | Gustafson et al. | 428/552 |
| 5,750,247 | A | | 5/1998 | Bryant et al. | 428/323 |
| 5,776,588 | A | * | 7/1998 | Moriguchi et al. | 428/210 |
| 5,841,045 | A | | 11/1998 | McCandlish et al. | 75/236 |
| 5,920,760 | A | | 7/1999 | Yoshimura et al. | 428/551 |
| 5,942,318 | A | | 8/1999 | Seöderberg et al. | 428/216 |
| 5,955,186 | A | | 9/1999 | Grab | 428/312.8 |
| 5,976,707 | A | | 11/1999 | Grab et al. | 428/547 |
| 5,984,593 | A | | 11/1999 | Bryant | 407/119 |
| 6,017,488 | A | | 1/2000 | Weinl et al. | 419/26 |
| 6,022,175 | A | | 2/2000 | Heinrich et al. | 407/119 |
| 6,250,855 | B1 | | 6/2001 | Persson et al. | 407/119 |

OTHER PUBLICATIONS

PCT International Application No. PCT/US01/21166—International Search Report of Apr. 5, 2002.

Kennametal Lab Report K3567 on Iscar IC656 and unknown Sumitomo Tools (Jul., 1985).

Kennametal Lab Report on Kustom Machine & Tool Grade IT–110 (Jun., 2000).

Summary of Kennametal Lab Report on Bohlerit Grade R421 (Mar., 1989).

Summary of Kennametal Lab Report on Carolina Coatings Grade BC–1 (Apr., 1992).

Summary of Kennametal Lab Report on Mitsubishi Grade UC5005 (Dec., 1998).

Summary of Kennametal Lab Report on North American Carbide NS326 (Apr., 1999).

Summary of Kennametal Lab Report on North American Carbide NS675 (Jul., 1994).

Kennametal Lab Report R4307 on North American Carbide NS675 (Jul., 1994).

Summary of Kennametal Lab Report on Plansee Grade TCC10 (Jan., 1996).

Summary of Kennametal Lab Report on Sumitomo, Igetaloy Grade AC 230 (Jul., 1997–Nov., 1996).

Summary of Kennametal Lab Report on Sumitomo, Igetaloy Grade AC 304 (Nov., 1998).

Summary of Kennametal Lab Report on Sumitomo, Igetaloy Grade K153R2 (Feb., 1997).

Summary of Kennametal Lab Report on Toshiba Grade TD915 (Oct., 1998).

Kennametal Lab Report R4656 on Toshiba–Tungaloy Grade TD915 (Oct., 1998).

Summary of Kennametal Lab Report on Toshiba Grade T841 (Jul., 1992).

Summary of Kennametal Lab Report on Teledyne Firth Sterling Grade KM21 (Apr., 1994).

Summary of Kennametal Lab Report on Valenite W6–S7 (Jul., 1999).

English Abstract of JP6212341A, Sintered Hard Alloy and Its Production (Jan. 1994).

English Abstract of JP7216492A, Hard Material and Its Production (Aug., 1995).

English Abstract of JP11221708A, Cemented–Carbide Miniature Drill with Excellent Abrasion Resistance (Aug. 1999).

English Abstract of JP9295205A, Throw Away Insert Made of Coated Cemented Carbide and Manufacture Thereof (Nov. 1997).

English Abstract of JP5329703A, Surface Coated Cemented Carbide Cutting Tool (Dec. 1993).

Henjered et al., "Quantative microanalysis of carbide/carbide interfaces in WC–Co base cemented carbides", Materials Science and Technology vol. 2 (Aug. 1986) pp. 847–855.

Santhanam et al., An Advanced Cobalt–enriched Grade Designed to Enhance Machining Productivity, ASM's Int'l Conf on High Productivity Machining, Materials and Processing, New Orleans, LA 1985 Paper No. 8503–003 pp. 1–8.

ASTM Designation No. B276–91(Reapproved 1996), Standard Test Method for Apparent Porosity in Cemented Carbides (1996), pp. 1–6.

* cited by examiner

CHROMIUM-CONTAINING CEMENTED TUNGSTEN CARBIDE BODY

FIELD OF THE INVENTION

The invention pertains to a chromium-containing cemented tungsten carbide body such as a cutting insert. While applicants contemplate other applications, these cutting inserts are suitable for the milling of various metals including without limitation titanium and titanium alloys, steel alloys, and cast iron alloys.

BACKGROUND OF THE INVENTION

Titanium metal and many of its alloys (e.g., Ti—6Al—2Zr—2Mo and Ti—6Al—4V) possess a high strength-weight ratio at high temperatures, as well as exceptional corrosion resistance. These very desirable properties allow titanium and its alloys to have particular application to the aerospace industry for use in airframes and engine components. Titanium and titanium alloys also have application for use in medical components, steam turbine blades, superconductors, missiles, submarine hulls, chemical processing equipment and other products where corrosion resistance is a concern.

Titanium and titanium alloy possess physical properties that make them difficult to mill. These special challenges require the careful selection of cutting inserts used in the milling of titanium and titanium alloys.

Among the metalcutting processes, milling places the most demands on the cutting insert. The cutting insert repeatedly enters, cuts and then exits the workpiece, and thus sustains repeated mechanical and thermal shocks. Thermal shocks and mechanical shocks can each result in microchipping of the cutting edge of the cutting insert.

Titanium and titanium alloys have a low thermal conductivity so as to worsen the ability to transfer heat into the workpiece. The temperature at the interface of the chip and the cutting insert may be about 1100 degrees Centigrade. At an interface temperature of greater than about 500 degrees Centigrade, titanium and titanium alloys are chemically reactive with some cutting insert materials, as well as the nitrogen and oxygen in the air. The combination of the high temperatures and the high chemical reactivity results in diffusion of elements from the cutting insert into the chips to cause cratering of the cutting insert.

The cutting insert-chip interface may also be under high pressure. For example, these pressures can be in the range of 1.38 to 2.07 gigapascal. These high pressures at the cutting edge may lead to the deformation and fracture of the cutting edge.

U.S. Pat. No. 5,750,247 to Bryant et al., which is hereby incorporated by references herein, further describes milling operations. U.S. Pat. No. 5,984,593 to Bryant, which is hereby incorporated by reference herein, further describes the milling of titanium and titanium alloys.

While earlier coated cutting insert have satisfactory performance, it would be desirable to provide a coated cutting insert that has improved ability to be able to withstand the mechanical shocks and thermal shocks of a milling operation. It would also be desirable to provide a coated cutting insert that is able to better resist cratering, deformation and fracturing due to the high temperatures and high pressures at the cutting insert-chip interface. Although these coated cutting inserts may have application to metalcutting applications in general, they would have specific application to the milling of titanium and its alloys, steel alloys, and cast iron alloys.

SUMMARY OF THE INVENTION

In one form, the invention is a coated cutting insert that comprises a tungsten carbide-based substrate that has a rake surface and a flank surface, the rake surface and the flank surface intersect to form a substrate cutting edge. The substrate comprises between about 10.4 weight percent and about 12.7 weight percent cobalt, between about 0.2 weight percent and about 1.2 weight percent chromium, tungsten and carbon. There is a coating on the substrate. Preferably, chromium is present at about 0.3 to 0.8 weight percent of the substrate.

In another form thereof the invention is a coated cutting insert that comprises a tungsten carbide-based substrate that has a rake surface and a flank surface, the rake surface and the flank surface intersect to form a cutting edge. The substrate consists essentially of greater than about 10.5 weight percent cobalt, greater than about 0.4 weight percent chromium, and less than about 89.1 weight percent tungsten and carbon. There is a coating on the substrate.

In still another form thereof, the invention is a tungsten carbide-based cutting insert substrate that comprises a rake surface and a flank surface wherein the rake surface and the flank surface intersect to form a substrate cutting edge. The tungsten carbide-based substrate comprises between about 10.4 weight percent and about 12.7 weight percent cobalt, between about 0.2 weight percent and about 1.2 weight percent chromium.

BRIEF DESCRIPTION OF THE DRAWINGS

The following is a brief description of the drawings that form a part of this patent application.

DETAILED DESCRIPTION OF THE INVENTION

Figure 1:
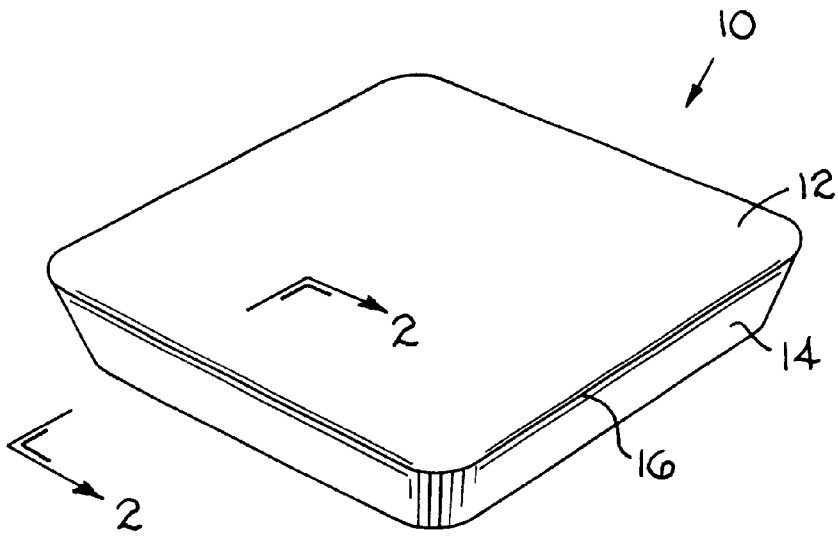
FIG. 1 is an isometric view of a specific embodiment of a cutting insert.
Figure 2:
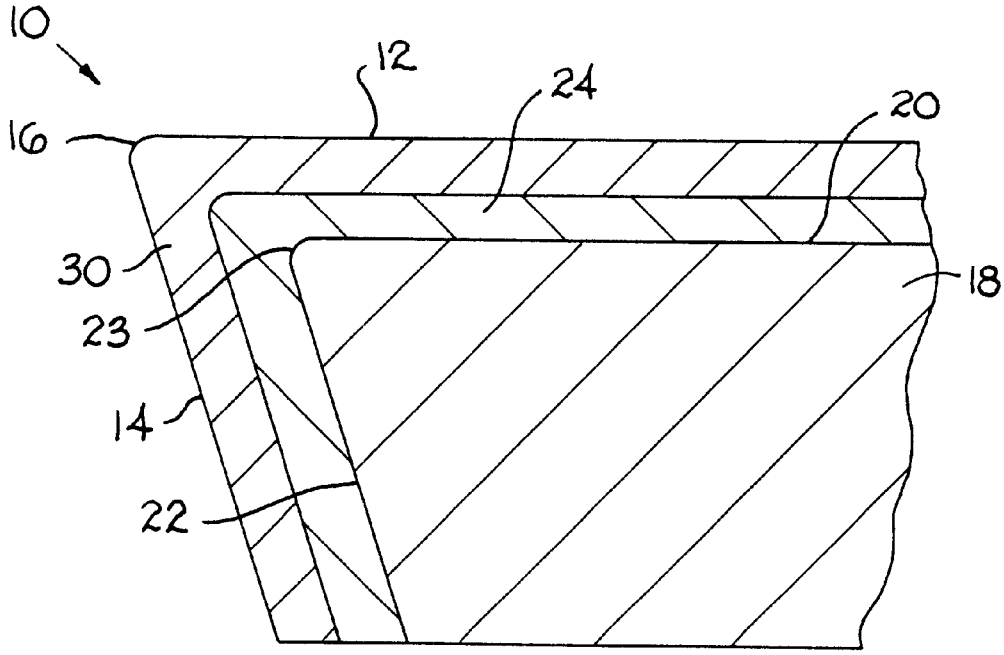
FIG. 2 is a cross-sectional view of the cutting insert of FIG. 1 taken along section 2—2 of FIG. 1.

Referring to the drawings, FIGS. 1 and 2 illustrate a first specific embodiment of a cutting insert generally designated as 10. The cutting insert is made by typical powder metallurgical techniques. One exemplary process comprises the steps of ball milling (or blending) the powder components into a powder mixture, pressing the powder mixture into a green compact, and sintering the green compact so as to form an as-sintered substrate.

In the present embodiments the typical components of the starting powders comprise tungsten carbide, cobalt, and chromium carbide. As one option, carbon may be a component of the starting powder mixture to adjust the overall carbon content. As still another option, solid solution carbide-forming elements such as titanium, hafnium, zirconium, niobium, and tantalum may also be present in the starting powder. Vanadium may also be present in the starting powder.

Cutting insert 10 has a rake face 12 and a flank face 14. The rake face 12 and the flank face 14 intersect to form a cutting edge 16. Cutting insert 10 further includes a substrate 18 that has a rake surface 20 and a flank surface 22. The rake surface 20 and the flank surface 22 of the substrate 18 intersect to form a substrate cutting edge 23.

Referring to the composition of the substrate, in one range the substrate may comprise between about 10.4 weight percent to about 12.7 weight percent cobalt, between about 0.2 weight percent to about 1.2 weight percent chromium, tungsten, and carbon. The substrate may possibly include other elements such as titanium, hafnium, zirconium, niobium, tantalum and vanadium. In another range the substrate may comprise between about 11 weight percent to about 12 weight percent cobalt, between about 0.3 weight percent to about 0.8 weight percent chromium, tungsten, and carbon. The substrate may possibly include elements such as titanium, hafnium, zirconium, niobium, tantalum and vanadium.

The specific embodiment of the substrate of FIG. 1 has a composition that comprises about 11.5 weight percent cobalt, about 0.4 weight percent chromium and about 88.1 weight percent tungsten and carbon along with minor amounts of impurities. This specific embodiment of the substrate of FIG. 1 has the following physical properties: a coercive force ($H_C$) of about 159 oersteds (Oe), a magnetic saturation of about 141 gauss cubic centimeter per gram cobalt (gauss-$cm^3$/gm) [178 micro Tesla cubic meter per kilogram cobalt ($\mu$T-$m^3$/kg).

The cutting insert 10 has a coating scheme that comprises a base coating layer 24. Base coating layer 24 is applied to the surfaces, i.e., the rake surface 20 and the flank surfaces 22, of the substrate 18. An outer coating 30 is applied to the surfaces of the base coating layer 24.

In one embodiment, the base coating layer 24 is titanium carbonitride applied by conventional chemical vapor deposition (CVD) to a thickness of about 2.0 micrometers, and the outer coating 30 is alumina applied by conventional CVD to a thickness of 2.3 micrometers. Conventional CVD techniques that are well-known in the art and typically occur at temperatures between about 900–1050 degrees Centigrade.

In alternate embodiments, applicants contemplate that the base coating layer may comprise any one of the nitrides, carbides and carbonitrides of titanium, hafnium and zirconium and additional coating layers may comprise one or more of alumina and the borides, carbides, nitrides, and carbonitrides of titanium, hafnium, and zirconium. Titanium aluminum nitride may also be used as a coating either alone or in conjunction with the other coating layers previously mentioned. These coating layers may be applied by any one or combination of CVD, physical vapor deposition (PVD), or moderate temperature chemical vapor deposition (MTCVD). U.S. Pat. No. 5,272,014 to Leyendecker et al. and U.S. Pat. No. 4,448,802 to Behl et al. disclose PVD techniques. Each one of U.S. Pat. No. 4,028,142 to Bitzer et al. and U.S. Pat. No. 4,196,233 to Bitzer et al. discloses MTCVD techniques, which typically occur at a temperature between 500–850 degrees Centigrade.

The inventors believe that essentially all of the chromium is in the binder and that preferably during the CVD coating operation, chromium from the substrate diffuses into the base coating layer. The base coating layer is preferably one of the carbides, nitrides, or carbonitrides of titanium, hafnium, or zirconium. When during the CVD coating operation cobalt also diffuses into the base coating layer, the ratio of chromium to cobalt in atomic percent (Cr/Co ratio) in the base coating layer is greater than the Cr/Co ratio in the substrate. The inventors believe that diffusion of chromium during CVD coating (>900° C.) into the base layer coating from the substrate enhances coating adhesion during metalcutting and forms a chromium solid solution with the base layer material (e.g., a titanium chromium carbonitride or titanium tungsten chromium carbonitride) having improved wear resistance and adhesion.

Applicants' assignee is the assignee of co-pending United States patent application entitled CHROMIUM-CONTAINING CEMENTED CARBIDE BODY and filed on the same day as this patent application (Kennametal Inc., U.S. Ser. No. 09/638,048). This co-pending patent application pertains to a chromium-containing cemented carbide body (e.g., tungsten carbide-based cemented carbide body) that has a surface zone of binder alloy enrichment.

Applicants' assignee is also the assignee of co-pending United States patent application entitled CHROMIUM-CONTAINING CEMENTED TUNGSTEN CARBIDE BODY, and filed on the same day as this patent application (Kennametal Inc., U.S. Ser. No. 09/637,762). This co-pending patent application pertains to a chromium-containing cemented carbide body (e.g., tungsten carbide-based cemented carbide body) that has a substrate that comprises between about 5.7 weight percent and about 6.4 weight percent cobalt, between about 0.2 weight percent and about 0.8 weight percent chromium, tungsten and carbon. There is a coating on the substrate.

Figure 3:
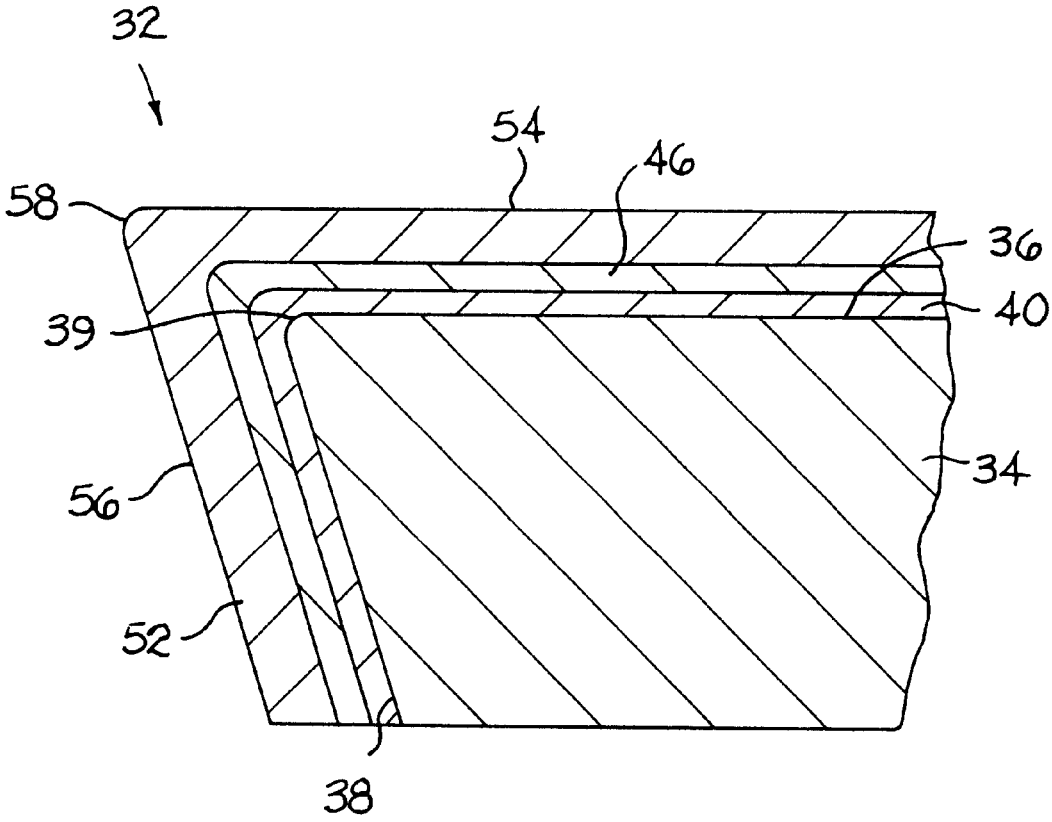
FIG. 3 is a cross-sectional view of a second embodiment of a cutting insert that illustrates a coating scheme in which there is a base coating layer, a mediate coating layer and an outer coating layer.

FIG. 3 illustrates a cross-sectional view of a second specific embodiment of a cutting insert generally designated as 32. Cutting insert 32 comprises a substrate 34 that has a rake surface 36 and a flank surface 38. The rake surface 36 and the flank surface 38 intersect to form a substrate cutting edge 39. The composition of the substrate of the second specific embodiment of the cutting insert is the same as the composition of the substrate of the first specific embodiment of the cutting insert.

Cutting insert 32 has a coating scheme. The coating scheme includes a base coating layer 40 applied to the surfaces of the substrate 34, a mediate coating layer 46 applied to the base coating layer 40, and an outer coating layer 52 applied to the mediate coating layer 46. The cutting insert 32 has a rake face 54 and a flank face 56 that intersect to form a cutting edge 58.

In the embodiment of the cutting insert of FIG. 3, the base coating layer 40 comprises a layer of titanium nitride applied by conventional CVD to a thickness of about 0.7 micrometers, the mediate coating layer 46 comprises a layer of titanium carbonitride applied by MTCVD to a thickness of about 2.2 micrometers, and an outer coating layer 52 of alumina applied by conventional CVD to a thickness of about 1.5 micrometers. Applicants contemplate that alternate coating schemes along the lines of those described in conjunction with the first specific embodiment (FIGS. 1 and 2) are suitable for use with the second specific embodiment.

As one exemplary metalcutting application, these cutting inserts are suited for the rough milling of titanium and titanium alloys. Typical operating parameters are a speed equal to about 200 surface feet per minute (sfm); a feed equal to between 0.006–0.008 inches per tooth (ipt); and an axial depth of cut (a.doc) equal to between 0.200–0.400 inches and a radial depth of cut (r.doc) equal to between 0.050–1.500 inches. Another exemplary metalcutting application is the rough milling of steel. Typical operating parameters for the milling of steel comprise a speed equal to 500 sfm, a feed equal to 0.010 ipt, an axial depth of cut (a.doc) equal to 0.100 inches and a radial depth of cut (r.doc) equal to 3.0 inches.

Examples 1–6 are specific embodiments of the cutting inserts of the invention. Examples 1–6 were compared in flycut face milling tests against commercially available cutting inserts sold under the designation KC994M by Kennametal Inc. of Latrobe, Pennsylvania 15650 (USA). The composition and physical properties of the substrate for all of Examples 1–6 was: about 11.5 weight percent cobalt, about 0.4 weight percent chromium and about 89.1 weight percent tungsten and carbon; a coercive force ($H_C$) of about 159 oersteds (Oe), a magnetic saturation of about 88 percent wherein 100 percent magnetic saturation equates to 202 micro Tesla cubic meter per kilogram cobalt ($\mu$T-m$^3$/kg)

For the coating schemes, Examples 1 and 4 had a single layer of titanium carbonitride applied to the substrate by PVD to a thickness of about 3.0 micrometers. Examples 2 and 5 had a base layer of titanium carbonitride applied to the substrate by conventional CVD to a thickness of about 2.0 micrometers and an outer layer of alumina applied to the base layer by conventional CVD to a thickness of about 2.3 micrometers. Examples 3 and 6 had a base layer of titanium nitride applied to the substrate by conventional CVD to a thickness of about 0.7 micrometers, a mediate layer of titanium carbonitride applied to the base layer by MTCVD to a thickness of about 2.2 micrometers and an outer layer of alumina applied to the mediate layer by conventional CVD to a thickness of about 1.5 micrometers.

The Kennametal KC994M cutting insert had substrate composition of about 11.5 weight percent cobalt, about 1.9 weight percent tantalum, about 0.4 weight percent niobium and the balance tungsten and carbon and minor impurities. The KC994M coating scheme comprised a base layer of titanium carbonitride applied to the substrate by conventional CVD to a thickness of about 2.0 micrometers and an outer layer of alumina applied to the base layer by conventional CVD to a thickness of about 1.5 micrometers.

The test parameters for the flycut face milling of the titanium alloy (Ti6Al4V) and the steel alloy (4140 Steel) are set forth in Table 1 below. The cutting insert geometry used was SEHW-43A6.

TABLE 1

Test Parameters for Face Milling Tests

| Parameter/ Material | Speed (sfm) | Feed (ipt) (corrected for 45° lead angle) | Axial Depth of Cut (a.doc) [inches] | Radial Depth of Cut (r.doc) [inches] |
|---|---|---|---|---|
| Ti6Al4V | 200 | 0.00424 | 0.100 | 1.5 |
| 4140 Steel | 500 | 0.010 | 0.100 | 3.0 |

Table 2 below sets forth the relative tool life (in percent) of Examples 1–3 against the KC994M cutting inserts in the face milling of a Ti6Al4V titanium alloy per the test parameters set forth in Table 1 above. Table 3 below sets forth the relative tool life (in percent) of Examples 4–6 against the KC994M cutting inserts in the face milling of 4140 steel alloy per the test parameters set forth in Table 1 above.

TABLE 2

Relative Tool Life of Example 1–3 Against the KC994M Cutting Inserts in Face Milling of a Ti6Al4V Alloy

| Example | 1 | 2 | 3 |
|---|---|---|---|
| Relative Performance [in percent of KC994M Performance] | 88.1% | 176.2% | 105.9% |

TABLE 3

Relative Tool Life of Example 4–6 Against the KC994M Cutting Inserts in Face Milling of a 4140 Steel Alloy

| Example | 4 | 5 | 6 |
|---|---|---|---|
| Relative Performance [in percent of KC994M Performance] | 167.2% | 106.7% | 160.5% |

Overall, it is apparent that in the face milling of the titanium alloy, Example 2 had superior tool life over the other examples as well as the commercial cutting insert. In the face milling of the steel alloy, while Examples 4–6 each had better tool life than the commercial cutting insert, Examples 4 and 6 had superior tool life over the commercial cutting insert.

The patents and other documents identified herein are hereby incorporated by reference herein.

Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A coated cutting insert comprising:

a tungsten carbide-based substrate having a rake surface and a flank surface, the rake surface and the flank surface intersect to form a substrate cutting edge;

the substrate comprising between about 10.4 weight percent and about 12.7 weight percent cobalt, between about 0.2 weight percent and about 1.2 weight percent chromium, and between about 86.1 weight percent and about 89.4 weight percent tungsten carbide; and a coating on the substrate.

2. The coated cutting insert according to claim 1 wherein the substrate comprises between about 11 weight percent and about 12 weight percent cobalt and between about 0.3 weight percent and about 0.8 weight percent chromium.

3. The coated cutting insert according to claim 1 wherein the substrate comprises about 11.5 weight percent cobalt, about 0.4 weight percent chromium.

4. The coated cutting insert according claim 1 wherein the substrate having a hardness of between about 88.5 and about 91.8 Rockwell A, a coercive force of between about 120 and about 240 oersteds, a magnetic saturation of between about 143 and about 223 micro Tesla cubic meter per kilogram cobalt, and a tungsten carbide grain size of 1–6 micrometers.

5. The coated cutting insert according to claim 1 wherein the substrate having a hardness of between about 90 and about 91 Rockwell A, a coercive force ($H_C$) of between about 140 oersteds and about 170 oersteds, a magnetic saturation of between about 178 and about 202 micro Tesla cubic meter per kilogram cobalt.

6. The coated cutting insert according to claim 1 wherein the coating includes a base coating layer.

7. The coated cutting insert according to claim 6 wherein the base coating layer includes chromium and wherein the chromium diffuses into the base coating layer from the substrate during the coating process.

8. The coated cutting insert according to claim 7 wherein the atomic percent ratio of chromium to cobalt in the base coating layer is greater than the atomic percent ratio of chromium to cobalt in the substrate.

9. The coated cutting insert according to claim 1 wherein the coating comprising a layer of titanium carbonitride applied by physical vapor deposition.

10. The coated cutting insert according to claim 9 wherein the layer of titanium carbonitride is the sole layer of the coating, and the thickness of the layer being about 3 micrometers.

11. The coated cutting insert according to claim 1 wherein the coating comprising a layer of titanium carbonitride, and a layer of alumina.

12. The coated cutting insert according to claim 11 wherein the coating further including a layer of titanium nitride.

13. The coated cutting insert according to claim 12 wherein the layer of titanium carbonitride has a thickness between about 1.5 micrometers and about 2.5 micrometers, the layer of alumina has a thickness of between about 1.0 micrometers and about 3.0 micrometers, and the layer of titanium nitride has a thickness of less than or equal to about 1.0 micrometers.

14. The coated cutting insert according to claim 1 wherein the coating comprising a base layer of titanium nitride applied to the substrate by chemical vapor deposition, a mediate layer of titanium carbonitride applied to the base layer by moderate temperature chemical vapor deposition, and an outer layer of alumina applied to the mediate layer by chemical vapor deposition.

15. The coated cutting insert according to claim 14 wherein the base layer has a thickness of less than 1 micrometers, the mediate layer has a thickness of between about 2.0 and about 2.4 micrometers, and the outer layer having a thickness of between about 1.2 and about 1.8 micrometers.

16. The coated cutting insert according to claim 14 wherein the base layer has a thickness of less than 1 micrometers, the mediate layer has a thickness of about 2.2 micrometers, and the outer layer having a thickness of about 1.5 micrometers.

17. The coated cutting insert according to claim 14 wherein the base layer contains chromium and wherein the chromium diffuses into the base layer from the substrate during the coating process.

18. The coated cutting insert according to claim 17 wherein the atomic percent ratio of chromium to cobalt in the base coating layer is greater than the atomic percent ratio of chromium to cobalt in the substrate.

19. The coated cutting insert according to claim 1 wherein the coating comprising a base layer of titanium carbonitride applied by conventional chemical vapor deposition and an outer layer of alumina applied to the base layer by conventional chemical vapor deposition.

20. The coated cutting insert according to claim 19 wherein the base layer of titanium carbonitride has a thickness of between about 1 micrometers and about 3 micrometers, and the outer layer of alumina has a thickness of between about 2 micrometers and about 4 micrometers.

21. The coated cutting insert according to claim 19 wherein the base layer of titanium carbonitride has a thickness of about 2 micrometers and the outer layer of alumina has a thickness of about 2.3 micrometers.

22. The coated cutting insert according to claim 19 wherein the base layer contains chromium and wherein the chromium diffuses into the base layer from the substrate during the coating process.

23. The coated cutting insert according to claim 22 wherein the atomic percent ratio of chromium to cobalt in the base coating layer is greater than the atomic percent ratio of chromium to cobalt in the substrate.

24. The coated cutting insert according to claim 1 wherein the coating including one or more layers comprising one or more of titanium nitride, titanium carbonitride, titanium diboride, and titanium aluminum nitride.

25. The coated cutting insert according to claim 1 wherein the chromium is between greater than 1 weight percent and about 1.2 weight percent.

26. A coated cutting insert comprising:

a tungsten carbide-based substrate having a rake surface and a flank surface, the rake surface and the flank surface intersect to form a cutting edge;

the substrate consisting essentially of greater than about 10.5 weight percent cobalt, greater than about 0.4 weight percent chromium, and less than about 89.1 weight percent tungsten and carbon; and a coating on the substrate.

27. The coated cutting insert according to claim 26 wherein the coating comprising a layer of titanium carbonitride applied by physical vapor deposition.

28. The coated cutting insert according to claim 27 wherein the layer of titanium carbonitride contains chromium and wherein the chromium diffuses into the layer of titanium carbonitride from the substrate during the coating process.

29. The coated cutting insert according to claim 26 wherein coating comprising a base layer of titanium nitride applied to the substrate by chemical vapor deposition, a mediate layer of titanium carbonitride applied to the base layer by moderate temperature chemical vapor deposition, and an outer layer of alumina applied to the mediate layer by chemical vapor deposition, and the base layer has a thickness of less than 1 micrometers, the mediate layer has a thickness of between about 2.0 and about 2.4 micrometers, and the outer layer having a thickness of between about 1.2 and about 1.8 micrometers.

30. The coated cutting insert according to claim 29 wherein the base layer contains chromium and wherein the chromium diffuses into the base layer from the substrate during the coating process.

31. The coated cutting insert according to claim 26 wherein the coating comprising a base layer of titanium carbonitride applied by chemical vapor deposition and an outer layer of alumina applied to the base layer by chemical vapor deposition, and the base layer of titanium carbonitride has a thickness of between about 1 micrometers and about 3 micrometers, and the outer layer of alumina has a thickness of between about 2 micrometers and about 4 micrometers.

32. The coated cutting insert according to claim 31 wherein the base layer contains chromium and wherein the chromium diffuses into the base layer from the substrate during the coating process.

33. The coated cutting insert according to claim 26 wherein the substrate includes at least about 70 weight percent tungsten and carbon.

34. The coated cutting insert according to claim 26 wherein the chromium is greater than 1 weight percent.

35. A tungsten carbide-based cutting insert substrate comprising:

a rake surface and a flank surface, the rake surface and the flank surface intersect to form a substrate cutting edge;

the tungsten carbide-based substrate comprising between about 10.4 weight percent and about 12.7 weight percent cobalt, between about 0.2 weight percent and about 1.2 weight percent chromium and wherein tantalum is absent from the substrate.

36. The coated cutting insert according to claim 35 wherein the substrate comprises at least about 85 weight percent tungsten and carbon.

37. The coated cutting insert according to claim 35 wherein the substrate comprises at least about 70 weight percent tungsten and carbon.

38. The cutting insert substrate according to claim 35 wherein the substrate comprises between about 11 weight percent and about 12 weight percent cobalt, and between about 0.3 weight percent and about 0.8 weight percent chromium.

39. The cutting insert substrate according to claim 35 wherein the substrate having a hardness of between about 88.5 and about 91.8 Rockwell A, a coercive force of between about 120 and about 240 oersteds, a magnetic saturation of between about 143 and about 223 micro Tesla cubic meter per kilogram cobalt, and a tungsten carbide grain size of about 1 to about 6 micrometers.

40. The cutting insert substrate according to claim 35 wherein the substrate having a hardness of between about 90 and about 91 Rockwell A, a coercive force ($H_C$) of between about 140 and about 170 oersteds, and a magnetic saturation of between about 178 and about 202 micro Tesla cubic meter per kilogram cobalt.

41. The cutting insert substrate according to claim 35 wherein the chromium is between greater than 1 weight percent and about 1.2 weight percent.

* * * * *